United States Patent [19]

Harrison et al.

[11] Patent Number: 4,729,307

[45] Date of Patent: Mar. 8, 1988

[54] FORM ROLLER ATTACHMENT FOR LITHOGRAPHIC PRESS

[75] Inventors: Odis E. Harrison, 5076 College Grade Ct., San Diego, Calif. 92115; Samuel J. Kolman, San Diego, Calif.

[73] Assignee: Odis E. Harrison, San Diego, Calif.

[21] Appl. No.: 73,385

[22] Filed: Jul. 13, 1987

Related U.S. Application Data

[63] Continuation of Ser. No. 831,469, Feb. 19, 1986, abandoned.

[51] Int. Cl.[4] ..... B41L 27/32; B41F 7/26; B41F 31/30

[52] U.S. Cl. ..... 101/141; 101/148; 101/350

[58] Field of Search ..... 101/141, 142, 148, 350, 101/DIG. 28

[56] References Cited

U.S. PATENT DOCUMENTS

| | | | |
|---|---|---|---|
| 637,568 | 11/1899 | Hett | 101/148 |
| 793,022 | 6/1905 | Pancoast | 101/148 |
| 1,272,032 | 7/1918 | Goss | 101/148 |
| 2,238,050 | 4/1941 | Goedike | 101/148 |
| 2,622,521 | 12/1952 | Larsen | 101/148 |
| 2,703,525 | 3/1955 | Stempel | 101/148 |
| 2,802,417 | 8/1957 | Forbes | 101/350 |
| 2,845,860 | 8/1958 | Mestre | 101/177 |
| 2,846,220 | 5/1958 | Mestre | 271/31 |
| 2,859,692 | 11/1958 | Mestre | 101/217 |
| 2,890,884 | 6/1959 | Mestre | 271/56 |
| 2,899,202 | 8/1959 | Mestre | 271/53 |
| 2,915,970 | 12/1959 | Mestre | 101/144 |
| 2,929,321 | 3/1960 | Newbegin | 101/364 |
| 3,150,589 | 9/1964 | Senogles | 101/350 |
| 3,911,815 | 10/1975 | Banfer | 101/148 |
| 4,000,691 | 1/1977 | Fischer | 101/350 |
| 4,404,908 | 9/1983 | Simeth | 101/148 |
| 4,455,938 | 6/1984 | Loudon | 101/148 |

FOREIGN PATENT DOCUMENTS

| | | | |
|---|---|---|---|
| 17720 | 10/1980 | European Pat. Off. | 101/DIG. 28 |
| 2659557 | 7/1978 | Fed. Rep. of Germany | 101/350 |
| 2902047 | 7/1979 | Fed. Rep. of Germany | 101/148 |
| 1559998 | 1/1980 | United Kingdom | 101/DIG. 28 |

*Primary Examiner*—Clyde I. Coughenour
*Attorney, Agent, or Firm*—Baker, Maxham & Jester

[57] ABSTRACT

An attachment for a lithographic press includes an additional form roller with a chain of ink rollers from an auxiliary oscillator roller to the form roller mounted in a detachable frame assembly, including a gear train for driving the rollers and an eccentric for raising and lowering the form roller into engagement with the plate cylinder of the lithographic press.

5 Claims, 6 Drawing Figures

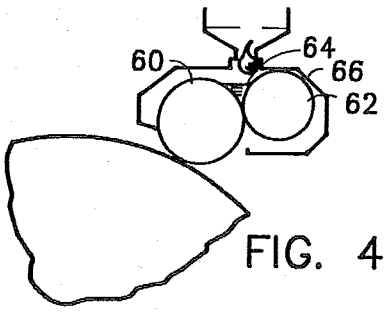
FIG. 4
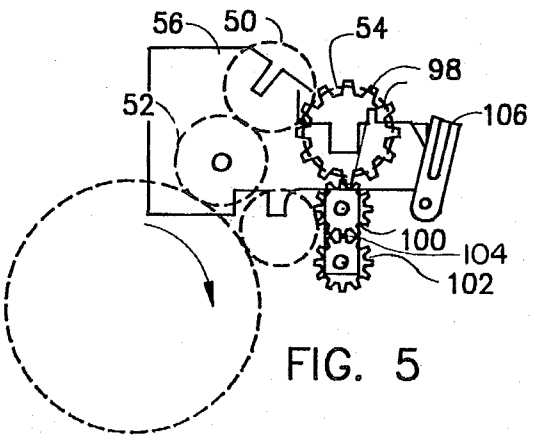
FIG. 5
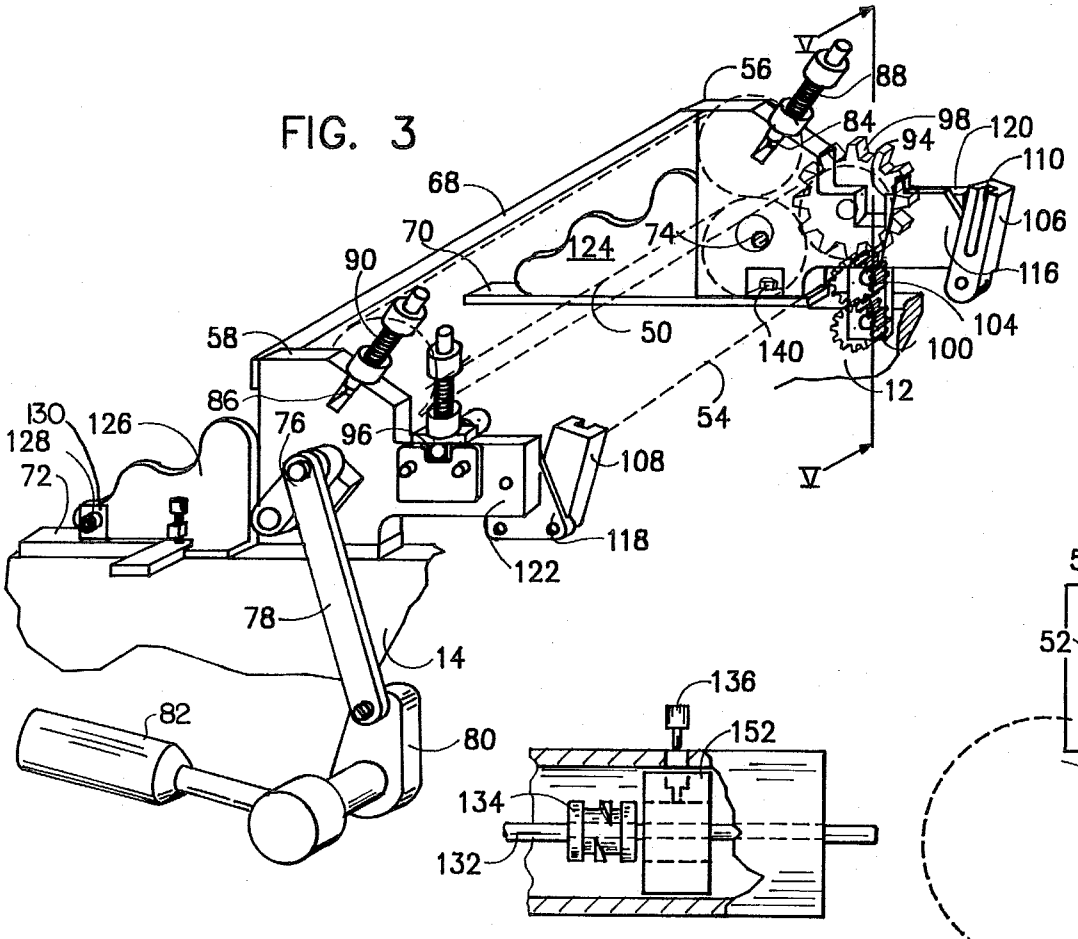
FIG. 3
FIG. 6

FORM ROLLER ATTACHMENT FOR LITHOGRAPHIC PRESS

This is a continuation of co-pending application Ser. No. 831,469 filed on Feb. 19, 1986, now abandoned.

BACKGROUND OF THE INVENTION

The present invention relates to printing presses, and pertains particularly to an improved ink system for lithographic printing presses.

The majority of lithographic printing presses have two ink form rollers of equal size for applying ink to the plate cylinder. A train of ink rollers transfers ink from an ink fountain to the two form rollers which apply the ink to the printing plates as the plate cylinder rotates.

Such lithographic presses are widely used and are satisfactory for most printing applications. However, where a printing job requires large areas of solid ink, heavy type, or high resolution half tones, the rollers develop ink deficient areas, often referred to as ink starvation.

This problem is solved to a large extent on larger printing presses by additional form rollers and ink trains that are built into the machines initially. Efforts to solve this problem for the smaller lithographic machines have been essentially unsuccessful. One problem with the lithographic presses is the lack of space to add additional form rollers and/or ink trains. The available space around the plate cylinder is taken up by the dampening system and the normally adequate existing ink system.

An example of a machine for which the above problems apply and for which the present invention is specifically designed to solve is the ATF-Davidson Company Chief models of machines as illustrated in FIG. 1 of the drawings and designed prior art. The construction and operation of these machines are more fully illustrated and described in the publication entitled Operator Manual for the ATF Chief Offset Duplicators; revised November, 1983 and published by ATF-Davidson Company, Whitinsville, Massachusetts, 01588. This publication is incorporated herein by reference.

This machine designated generally by the number 10, as schematically illustrated in FIG. 1, includes a frame comprising a pair of side frame members 12 and 14 between which the operating mechanism of the printing press is mounted. The press has a front end into which paper is fed at the right side of the illustrated embodiment and printing rollers to which the paper moves as it is being printed and discharged at the back or discharge end of the machine.

The roller arrangement for the inking and watering system of the machine is as illustrated in FIG. 1. The basis system includes a plate cylinder 16 with an ink train comprising a series of rollers extending outward in a substantially horizontal direction from the plate zone toward the rear of the machine. The inking system comprises a pair of form rollers 18 and 20 which are in rolling engagement with the plate cylinder and are engaged by a main oscillating roller 22, which oscillates along its axis as it transfers ink to the form rollers. A pair of idler rollers 24 and 26 are each respectively in rolling contact or engagement with the surfaces of the form rollers 18 and 20.

A back idler roller 28 is in rolling contact with the main oscillator 22 and with a distributor roller 30, which is intermittently contacted by a ductor roller 32, which oscillates transverse to its axis for transferring ink thereto from a fountain roller 34 which is in intermittently contact. An auxiliary oscillator roller is mounted above and in rolling contact with the back idler roller 28. The above described rollers have specific nomenclature and such nomenclature defines rollers of specific characteristics in the industry.

The dampening system for the printing press comprises a form roller 40 in rolling contact with the plate cylinder 16 and including an oscillator roller 42 in contact with the form roller 40. A ductor roller 44 oscillates transverse to its axis between a fountain or fountain roller 46 for transferring water from the fountain 46 to the oscillator roller 42. The ductor roller 44 is typically adjustable in its oscillation for adjusting the amount of moisture transferred from the fountain to the plate cylinder.

The above described arrangement is typical of the small printing presses of the lithographic type, and illustrates the problem encountered. The ink supply is typically insufficient for certain applications and as is typical, there is insufficient room typically to add another form roller or the like.

Therefore, it is desirable that an improved ink system for lithographic presses be available.

SUMMARY AND OBJECTS OF THE INVENTION

It is a primary object of the present invention to provide an improved ink supply system for a lithographic printing press.

In accordance with a primary aspect of the present invention, an ink roller attachment for a lithographic printing press of the type having first and second form rollers, comprises an auxiliary frame for detachable attachment to the frame of a printing press with a plurality of ink rollers rotatably mounted in the auxiliary frame and comprising a third form roller for engagement with the plate cylinder of the printing press, an idler roller and an oscillator roller forming a train between a roller adjacent the ink fountain and the third form roller.

BRIEF DESCRIPTION OF THE DRAWING

The above and other objects and advantages of the present invention will become apparent from the following description when read in conjunction with the accompanying drawing wherein:

FIG. 3 is perspective view of the attachment of the present invention;

FIG. 4 is a schematic illustration of a compact water fountain for the present invention;

FIG. 5 is a view taken generally on line V—V of FIG. 3; and,

FIG. 6 is an enlarged section view showing details of the oscillator roller.

DETAILED DESCRIPTION OF A PREFERRED EMBODIMENT

Figure 1:
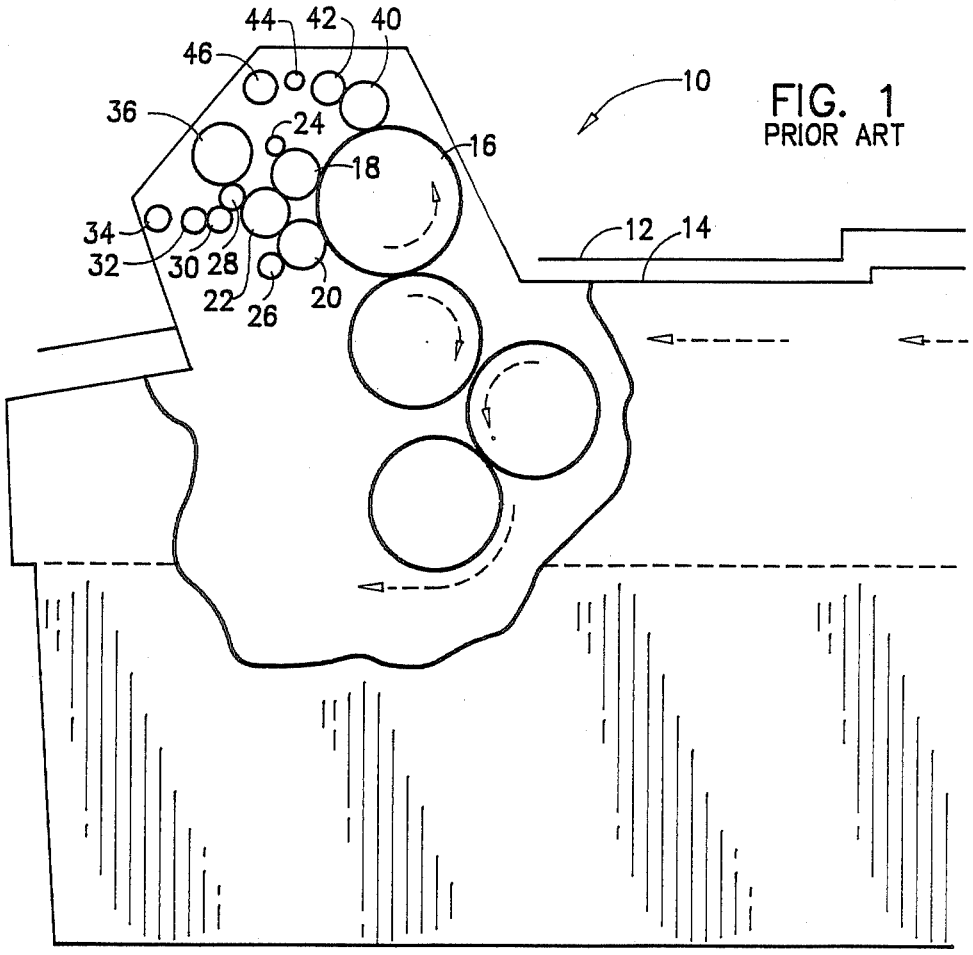
FIG. 1 PRIOR ART
FIG. 1 is a schematic illustration of the typical roller arrangement of the prior art.
Figure 2:
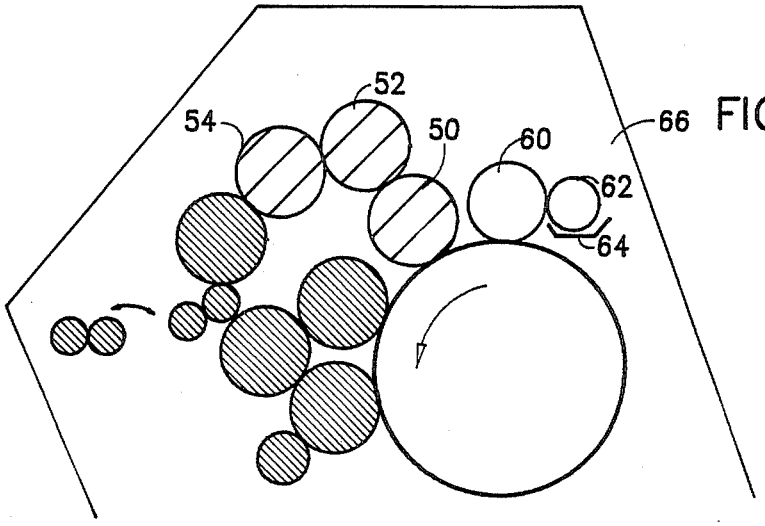
FIG. 2 is a schematic illustration, like FIG. 1, of a preferred embodiment of the present invention.

Referring to FIG. 2 of the drawings, a schematic illustration of the printing press of FIG. 1 embodying the present invention is shown. In FIG. 2, and the subsequent drawings, the identical structure will be identified by the same reference numeral.

The applicant's basic invention comprises an attachment for the lithographic printing press that, as illustrated, comprises an additional ink train in the form of a third form roller 50 in rolling contact with the plate cylinder 16, with an oscillating roller 52 in contact with the third form roller 50, and a roller 54 in rolling contact between the oscillator 52 and the oscillator roller 36. These rollers are mounted in a bracket or auxiliary frame assembly, as illustrated in FIGS. 3 and 5, and are positioned essentially where the former dampening system for the machine was located.

In order to adapt the present attachment to the machine, the existing water system is removed and replaced by a water system that is smaller and more compact than that originally provided and extends forward of the plate cylinder. A water system suitable for use with the present ink system is illustrated schematically in FIG. 4. This water system basically comprises a water form roller 60 and a fountain or metering roller 62 in rolling engagement with the form roller. A housing encompasses the roller, and a fountain supply of water 64 is disposed above and meters water to the water fountain system encompassed by a housing 66.

Referring more particularly to FIG. 3, the ink attachment basically comprises a pair of auxiliary frame members 56 and 58 which are tied together by means of a top bar 68 and between which the three rollers 50, 52, and 54 of the auxiliary ink system of the present invention are mounted. The frame members 56 and 58 each are mounted on an adaptor or base plate 70 and 72 that mounts directly to the top of the side frames 12 and 14 of the printing machine and are tapped to mount directly to existing bolt holes therein from which the manufacturers damping system has been removed.

The frame members 56 and 58 each have a generally rectangular main body with extensions 120, 122 extending outward from one side in the plane thereof. The frame members are each provided with mounting means for the rollers. A bore in each of the frame members includes an eccentric (only one of which is shown) 74 rotatably mounted therein, and including an eccentrically located bore in which is rotatably mounted the third form roller 50. The disc 74 is circular having a shaft extending axially thereof and a bore that is offset from the axis thereof for receiving the roller shaft.

The mounting of the roller is such that rotation of the eccentrics 74 result in movement of the form roller 50 away from the plate cylinder. Operation of the eccentrics is carried out by means of a linkage system, including an arm (only one of which is shown) 76 connected to the shaft of the disc 74, and by link 78 to a second arm 80 attached to the water and form roller control shaft located on the machine, and which is operated by lever 82. A like linkage is provided on the opposite side of the machine for simultaneously operating the second eccentric.

The oscillator roller 52 is mounted between the plates 56 and 58 in slots 84 and 86 which are angled at about forty-five degrees. The slots are provided with biasing means 88, 90, which engage the roller shafts for biasing the roller into engagement with the form roller 50 and the top idler roller 54. The idler roller 54 is similarly mounted in an arrangement comprising slots 94 and 96 formed in extensions 120, 122 of the frame members 56 and 58.

The top idler roller 54 is positively driven by an auxiliary gear train, as shown in FIG. 5, comprising a pinion gear 98 connected directly to the shaft thereof. The gear train, includes idler pinion gears 100 and 102, which are connected to a driven gear on the machine that normally drives roller 22. These gears 100 and 102 are mounted on an arm 104 of plate 120.

An added bracket, including arms 106 and 108 at each side of the attachment, receives the auxiliary oscillator roller in slots 110 and 112. This positions the roller 36 in its proper relationship relative to the roller 28, which it normally engages, and the added top idler 54. The arms 106 and 108 are attached to plates 116 and 118, which are detachably mounted on the arms 120 and 122. These plates are also detachably mountable on the frame supporting the primary ink system of the machine. The gears 100 and 102 are mounted on shafts mounted on a downward arm of bracket 120.

The water fountain is modified in accordance with the invention to include a frame independently supporting the water rollers 60 and 62 that is detachably mounted between members 124 and 126 at each side of the auxiliary frame. These members 124 and 126 are attached to base plates 70 and 72 and the frame members 12 and 14 by hinge pins 128 extending through brackets 130, which are bolted to the frame members 12 and 14. The water fountain rollers 60 and 62 are mounted within a bracket on these hinge members which positions them in the proper position and replaces the existing water fountain system of existing machines.

Referring to FIG. 6, an oscillating mechanism for the oscillating roller 50 is illustrated. This mechanism comprises a cam member 134 fixed to the fixed shaft 134 with a nut or follower 136 mounted in the roller body and engaging the grooves in cam 134. As the roller rotates, the follower 136 follows the cam tracks forcing the roller to oscillate axially.

In carrying out the present invention, an auxiliary ink assembly constructed, as described above, is selected for attachment to the machine. The existing water fountain rollers and brackets of the machine are removed and replaced by a water fountain assembly as described above. In the preferred form, the water fountain rollers are mounted on or within the auxiliary frame of the present ink roller system. The ink roller system can then be mounted in position on the machine above the preexisting ink train. The water system is thus positioned above and forward of the plate cylinder while the ink system or train of the present invention is positioned above and extends aft to the auxiliary oscillator roller for picking up ink for transferring via the assembly of the present invention to the plate roller.

The above described invention provides a more complete ink coverage with improved ink control for printing solids, heavy type, and high resolution halftones. The increased ink coverage permits a finer dot size to be printed which increases resolution. By making the third ink form roller larger than the two existing ink form rollers, "ghosting" is eliminated because the ink starved areas do not coincide on the second revolution of the rollers. Ink is continually available when printing large solids, or heavy type, and will not "ghost" into halftones or tinted areas.

While we have illustrated and described our invention by means of specific embodiments, it is to be understood that numerous changes and modifications may be made therein without departing from the spirit and scope of the invention as defined in the appended claims.

We claim:

1. An ink roller attachment for a lithographic printing press having a main frame having a pair of spaced apart top edges, a plate cylinder, having a front and a back, for holding a lithographic printing plate, an ink system including an ink fountain and first and second form rollers engaging said plate cylinder, all said plate and rollers mounted within said main frame, said ink roller attachment comprising:

an auxiliary frame including a pair of spaced apart frame members connected together for detachable attachment to the main frame top edges of said printing press;

a pair of eccentrics rotatably mounted in coaxial alignment in said frame members for mounting a third form roller for selective engagement with said plate cylinder upon rotation of said pair of eccentrics;

an ink train comprising a plurality of ink rollers mounted in said auxiliary frame and including a third form roller mounted in said pair of eccentrics, an idler roller mounted between said frame members, a pair of plates extending outwardly from each of said frame members, and an oscillator roller mounted on arms attached to said plates, and said plurality of rollers forming an auxiliary ink train between a roller adjacent the ink fountain and the plate cylinder;

a gear train mounted on said auxiliary frame for driving said idler roller; and linkage means mounted on said auxiliary frame for rotating said eccentrics for selectively positioning said third form roller in and out of engagement with said plate cylinder.

2. An attachment according to claim 1 wherein:

said auxiliary frame includes first bracket means for mounting a water system for the plate cylinder; and second bracket means for mounting an auxiliary oscillator roller for engagement with said idler roller.

3. An ink roller attachment for a lithographic printing press of the type having a main frame defined by a pair of spaced apart vertical frame having a top horizontal edge, a plate cylinder for holding a lithographic printing plate, an ink system including an ink fountain and first and second form rollers engaging the back of said plate cylinder, the plate cylinder and the form rollers mounted within said main frame, said ink roller attachment comprising:

an auxiliary frame including a pair of spaced apart base plates including a pair of frame members mounted on said base plates and connected together for detachable attachment to the top horizontal edges of the main frame of said printing press;

a pair of eccentrics rotatably mounted in coaxial alignment in said frame members for mounting a third form roller for selective engagement with the top of said plate cylinder;

an ink train comprising a plurality of ink rollers mounted in said auxiliary frame and including a third form roller mounted in said pair of eccentrics for engaging the top of said plate cylinder, an upwardly opening slot in each of said frame members and an idler roller mounted in said slots, a pair of plates secured to and extending outwardly from each of said frame members and including arm each having an upwardly opening slot, and an oscillator roller mounted in said slots on said arms, and said plurality of rollers forming an auxiliary train between a roller adjacent the ink fountain and the plate cylinder;

a gear train mounted on said auxiliary frame for driving said idler roller; and linkage means mounted on said auxiliary frame for rotating said eccentrics for selectively positioning said third form roller in and out of engagement with said plate cylinder.

4. An attachment according to claim 3 wherein:

said frame includes first bracket means for mounting a water system for the plate cylinder; and second bracket means for mounting an auxiliary oscillator roller for engagement with said idler roller.

5. An ink roller attachment for a lithographic printing press of the type having a main frame defined by a pair of spaced apart vertical side members each having a top horizontal edge, a plate cylinder for holding a lithographic printing plate, an ink system including a fountain and a train including first and second form rollers engaging the back of said plate cylinder, the plate cylinder and the form rollers mounted within said main frame, said ink roller attachment comprising:

an auxiliary frame including a pair of spaced apart base plates including a pair of frame members mounted on said base plates and connected together for detachable attachment to the top horizontal edge of the main frame of said printing press;

a pair of eccentrics rotatably mounted in coaxial alignment in said frame members for mounting a third form roller for selective engagement with the top of said plate cylinder;

an ink train comprising a plurality of ink rollers mounted in said auxiliary frame and including a third form roller mounted in said pair of eccentrics for engaging the top of said form roller, linkage means for rotating said eccentrics for selectively positioning said third form roller in and out of engagement with said plate cylinder, an upwardly opening slot in each of said plate members and an idler roller mounted in said slots, a pair of plates extending outwardly from each of said frame members and including a pair of arms each having an upwardly opening slot, and an oscillator roller mounted in said slots on said arms, a gear train for driving said idler roller mounted on said auxiliary frame and said plurality of rollers forming an auxiliary train between a roller adjacent the ink fountain and the plate cylinder first bracket means on said auxiliary frame for mounting a water system for the plate cylinder; and second bracket means for mounting an auxiliary oscillator roller for engagement with said idler roller.

* * * * *